US011160389B2

(12) United States Patent
Svensson

(10) Patent No.: US 11,160,389 B2
(45) Date of Patent: Nov. 2, 2021

(54) SEATING FURNITURE SUPPORT ARRANGEMENT

(71) Applicant: IKEA Supply AG, Pratteln (CH)

(72) Inventor: Sebastian Svensson, Killeberg (SE)

(73) Assignee: IKEA SUPPLY AG, Pratteln (CH)

( * ) Notice: Subject to any disclaimer, the term of this patent is extended or adjusted under 35 U.S.C. 154(b) by 0 days.

(21) Appl. No.: 16/760,924

(22) PCT Filed: Oct. 23, 2018

(86) PCT No.: PCT/SE2018/051076

§ 371 (c)(1),
(2) Date: May 1, 2020

(87) PCT Pub. No.: WO2019/088894

PCT Pub. Date: May 9, 2019

(65) Prior Publication Data

US 2021/0169235 A1 Jun. 10, 2021

(30) Foreign Application Priority Data

Nov. 6, 2017 (SE) ..... 1751372-2

(51) Int. Cl.
*A47C 4/30* (2006.01)
*A47C 7/14* (2006.01)
(Continued)

(52) U.S. Cl.
CPC ..... *A47C 31/023* (2013.01); *A47C 4/30* (2013.01); *A47C 7/22* (2013.01); *A47C 31/026* (2013.01)

(58) Field of Classification Search
CPC ..... A47C 31/023; A47C 31/026; A47C 4/30; A47C 7/22
(Continued)

(56) References Cited

U.S. PATENT DOCUMENTS 1,933,040 A 10/1933 Baker
3,645,550 A 2/1972 Biehl
(Continued)

FOREIGN PATENT DOCUMENTS

EP 1348357 A2 10/2003
JP S5447605 U 4/1979

OTHER PUBLICATIONS

International Written Opinion for International Application No. PCT/SE2018/051076 dated Jan. 14, 2019 (13 pages).
(Continued)

*Primary Examiner* — Rodney B White
(74) *Attorney, Agent, or Firm* — Merchant & Gould P.C.

(57) ABSTRACT

A seating furniture support arrangement (6) for a seat or a backrest, suitable, e.g., for a sofa, comprises a first (8) and a second (10; 12) load-carrying longitudinal beam, each being mountable to a seating furniture frame comprising one or more parts; an elastic sheet (16; 14); and a mechanism for stretching the elastic sheet (16; 14) between the first longitudinal beam (8) and the second longitudinal beam (10; 12). The mechanism comprises a first longitudinal beam (8) pivotable on the frame. The elastic sheet (16; 14), with the said seating furniture support arrangement (6) in installed position, is connected to the first longitudinal beam (8) in such a way that the first longitudinal beam (8) pivoting with respect to the frame, in response to an application of an external force or torque, stretches the elastic sheet (16; 14), the external force or torque working against the tension force of the elastic sheet (16; 14) until a point of maximum tension is reached, past which point of maximum tension the tension force facilitates further pivoting of said first longitudinal beam (8), acting to keep the first longitudinal beam (8) in place in a final position.

11 Claims, 6 Drawing Sheets

(51) Int. Cl.
*A47C 31/02* (2006.01)
*A47C 7/22* (2006.01)

(58) Field of Classification Search
USPC ..... 297/284.2, 452.13, 452.56
See application file for complete search history.

(56) References Cited

U.S. PATENT DOCUMENTS 3,698,766 A * 10/1972 Borenstein ..... A47C 4/028 297/452.56
3,985,460 A * 10/1976 Piper ..... A47C 5/12 297/452.56 X
4,232,899 A * 11/1980 Fister, Jr. ..... A47C 31/023 297/229
4,828,324 A * 5/1989 Putnam ..... F16B 9/058 297/440.1
6,604,792 B1 8/2003 Picard
6,854,805 B2 * 2/2005 Fujita ..... B60N 2/7094 297/452.56
7,156,457 B2 * 1/2007 Fujita ..... B60N 2/42763 297/452.56 X
7,618,096 B2 * 11/2009 Fujita ..... B60N 2/7094 297/452.56
7,731,294 B2 * 6/2010 Yasuda ..... B60N 2/7041 297/452.56
2002/0145320 A1 * 10/2002 Zeiler ..... A47C 17/16 297/284.2
2006/0055216 A1 3/2006 Kawasaki
2006/0214476 A1 * 9/2006 Rojas ..... A47C 7/383 297/3
2011/0198909 A1 * 8/2011 Fifield ..... A47C 7/32 297/452.56

OTHER PUBLICATIONS

International Search Report for International Application No. PCT/SE2018/051076 dated Jan. 14, 2019 (13 pages).
Swedish Office Action for corresponding application No. 1751372-2 dated Jun. 4, 2018 (8 pages).
Extended European Search Report for European Patent Application No. 18873018.8 dated Jul. 19, 2021, 7 pages.

* cited by examiner

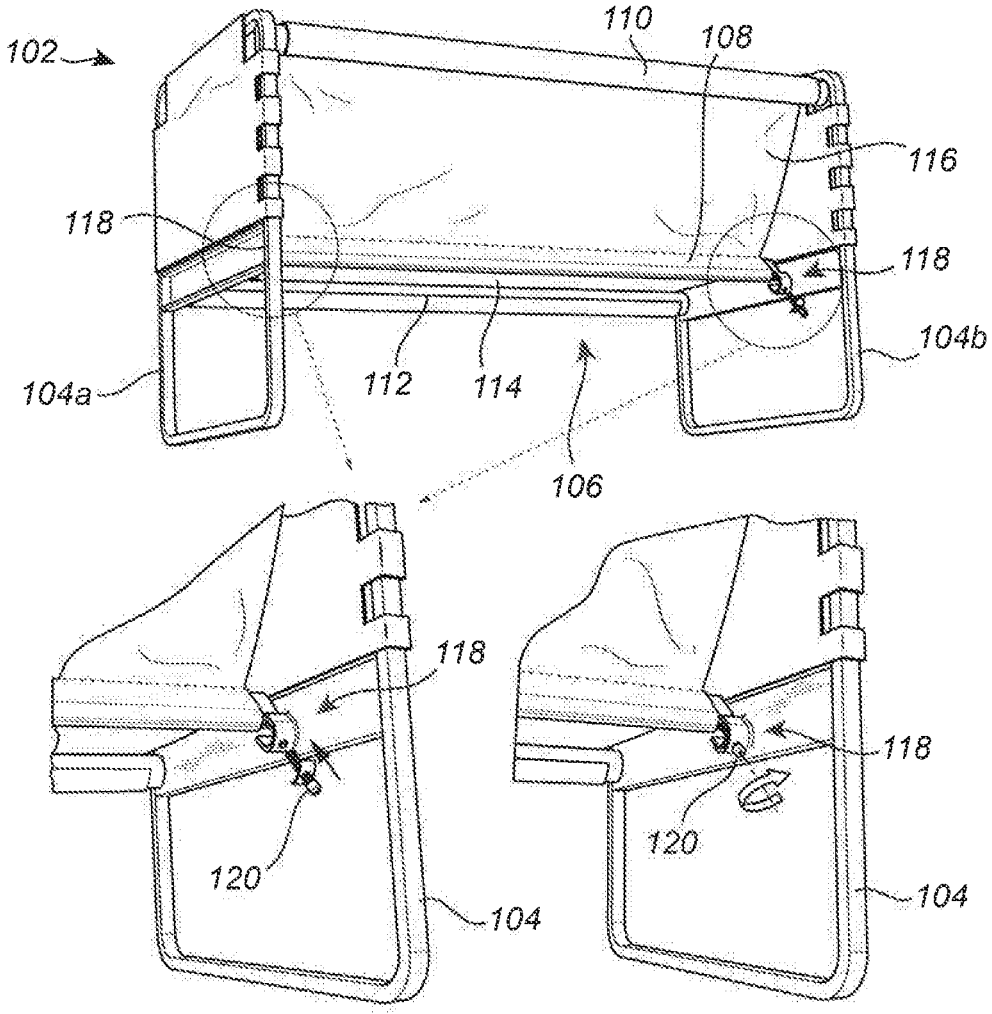
(Prior art) Fig. 1A (Prior art) Fig. 1B
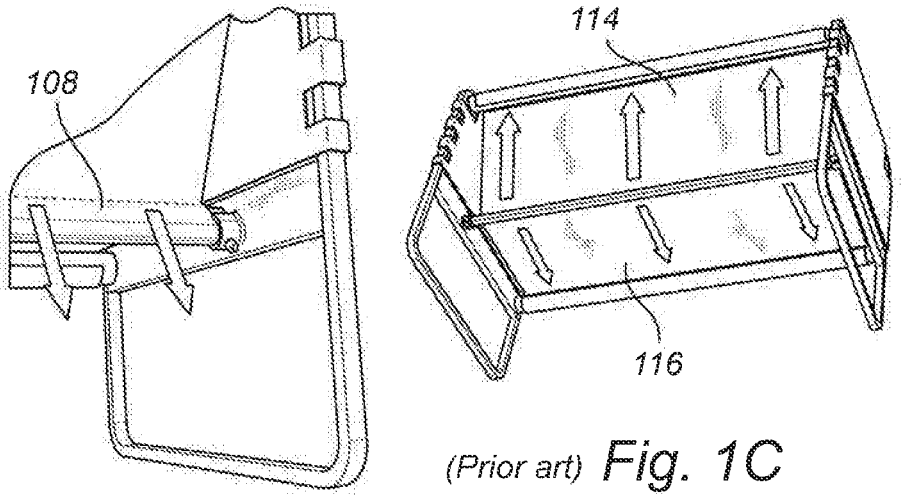
(Prior art) Fig. 1C

SEATING FURNITURE SUPPORT ARRANGEMENT

This application is a National Stage Application of PCT/SE2018/051076, filed 23 Oct. 2018, which claims benefit of Ser. No. 1751372-2, filed 6 Nov. 2017 in Sweden and which applications are incorporated herein by reference. To the extent appropriate, a claim of priority is made to each of the above disclosed applications.

FIELD OF TECHNOLOGY

The present invention relates to a seating furniture support arrangement for a seat or a backrest.

BACKGROUND

Sofa support arrangements where stretched sheets provide support for a sofa seat and/or a sofa backrest are known in the prior art. They may be designed to be assembled by persons not specially trained for the task at the point of future use.

FIG. 1 shows such an arrangement. A sofa 102 frame comprises a first short-end section 104*a*, a second short-end section 104*b* and a support arrangement 106 comprising a first longitudinal beam 108, a second longitudinal beam 110, and a third longitudinal beam 112, all beams running between the first short-end section 104*a* and the second short-end section 104*b* and thus carrying the load of the seat and its occupant(s) to the short-end sections 104*a*, 104*b*. A first sheet 114 may be stretched between the first longitudinal beam 108 and the second longitudinal beam 110 and a second sheet 116 may be stretched between the first longitudinal beam 108 and the third longitudinal beam 112 forming, respectively, a support for a seat and for a backrest. The seat and/or backrest may be formed by placing pillows on the sheets 114, 116. For stretching the sheets, there is a stretching mechanism 118: the first longitudinal beam may be manually pulled and fixed with a screw 120.

There is always a need to provide improve such an arrangement.

SUMMARY

To this end, there is provided a sofa seating furniture support arrangement for a seat or a backrest, comprising a first and a second load-carrying longitudinal beam, each being mountable to a seating furniture frame comprising one or more parts; an elastic sheet for providing support for one of the seat and the backrest; and a mechanism for stretching the elastic sheet between the first longitudinal beam and the second longitudinal beam. The mechanism comprises a stretching member pivotable on the frame around a pivot axis. The elastic sheet is, with the sofa seating furniture support arrangement in installed position, connected to the first longitudinal beam offset to said pivot axis so that the first longitudinal beam pivoting with respect to the frame, in response to an application of an external force or torque, stretches the elastic sheet, with the external force or torque working against the tension force of the elastic sheet until a point of maximum tension is reached, past which point of maximum tension the tension force facilitates further pivoting of the first longitudinal beam, acting to keep the first longitudinal beam in place in a final position.

This arrangement results in a tension mechanism that is easy to operate at the point of assembly, while still allowing for a high degree of tension in the elastic sheet, resulting in good rigidity of the support. This is turn allows for the use of the arrangement in in larger pieces of furniture than was previously possible.

In general, a large degree of elasticity is not required in the elastic sheets, i.e., their coefficient of elasticity, defined as the ratio of tension force to degree of stretching, may be rather high.

The load-carrying first longitudinal beam thus itself acting as a stretching member allows for a simple yet strong construction that still is easy to operate.

The elastic sheet may be a first elastic sheet and the seating furniture support arrangement may further comprise a third longitudinal beam and a second elastic sheet for providing support for the other of the seat and the backrest, where the second elastic sheet is also connected to the first longitudinal beam of the mechanism, so that the pivoting of the first longitudinal beam also stretches the second elastic sheet between the first beam and the third beam.

The seating furniture support arrangement may be arranged so that the external force or torque works against the tension force of one of the first elastic sheet and the second elastic sheet up to the point of maximum tension, the other of the first elastic sheet and the second elastic sheet only being stretched with the pivoting having passed the point of maximum tension. In this way, the tension force of one of the sheets may be used to stretch the other sheet past the point of maximum tension, with less force or torque being needed to pivot the first longitudinal beam up to that point, than if both elastic sheets had been stretched at the same time.

Alternatively, the seating furniture support arrangement may be arranged so that the external force or torque works against the tension forces of both the first elastic sheet and the second elastic sheet up to the point of maximum tension. This allows for a high final degree of tension in both sheets.

The elastic sheet may, with the seating furniture support arrangement in installed position, fold around the first longitudinal beam forming a pocket, preferably being closed by a seam. This arrangement is easy to manufacture while still being durable.

The seating furniture support arrangement may further comprise a lever for applying the external force or torque for pivoting the first longitudinal beam, where the lever preferably is removable or foldable after use. This makes it easy to operate the mechanism.

The seating furniture support arrangement may further comprise a stop, against which the tension force of the elastic sheet acts through the first longitudinal beam to lock the first longitudinal beam in place in the final position.

The seating furniture support may further comprise a latch further acting to lock the first longitudinal beam in place in the final position.

Further, there is provided a piece of seating furniture comprising the seating furniture support arrangement above, and a kit for assembling a piece of seating furniture, the kit comprising the support arrangement above.

According to a further aspect, there is provided a method of assembling a piece of seating furniture, comprising providing a seating furniture frame in one or more parts, a first load-carrying longitudinal beam and a second load-carrying longitudinal beam, each attached to the seating furniture frame, and an elastic sheet for providing support for a seat or a backrest; and stretching the elastic sheet between the first longitudinal beam and the second longitudinal beam, where the stretching of the elastic sheet comprises applying an external force or torque to pivot the first longitudinal beam with respect to the frame around a pivot axis, wherein the elastic sheet is connected to the first longitudinal beam offset to said pivot axis so that the pivoting stretches the elastic sheet, the external force or torque working against the tension force of the elastic sheet until a point of maximum tension is reached, past which point of maximum tension the tension force facilitates further pivoting of the first longitudinal beam, acting to lock the first longitudinal beam in place in a final position.

BRIEF DESCRIPTION OF THE DRAWINGS

FIGS. 1A, 1B, and 1C are perspective views of a sofa support arrangement according to the prior art.

DETAILED DESCRIPTION

FIG. 2A-2D show a seating furniture support arrangement 6 according to the present inventive concept. In this specific embodiment, the seating furniture support arrangement 6 is for a sofa 2, however, the arrangement is equally suitable for other pieces of seating furniture, such as an armchair.

Figure 2A:
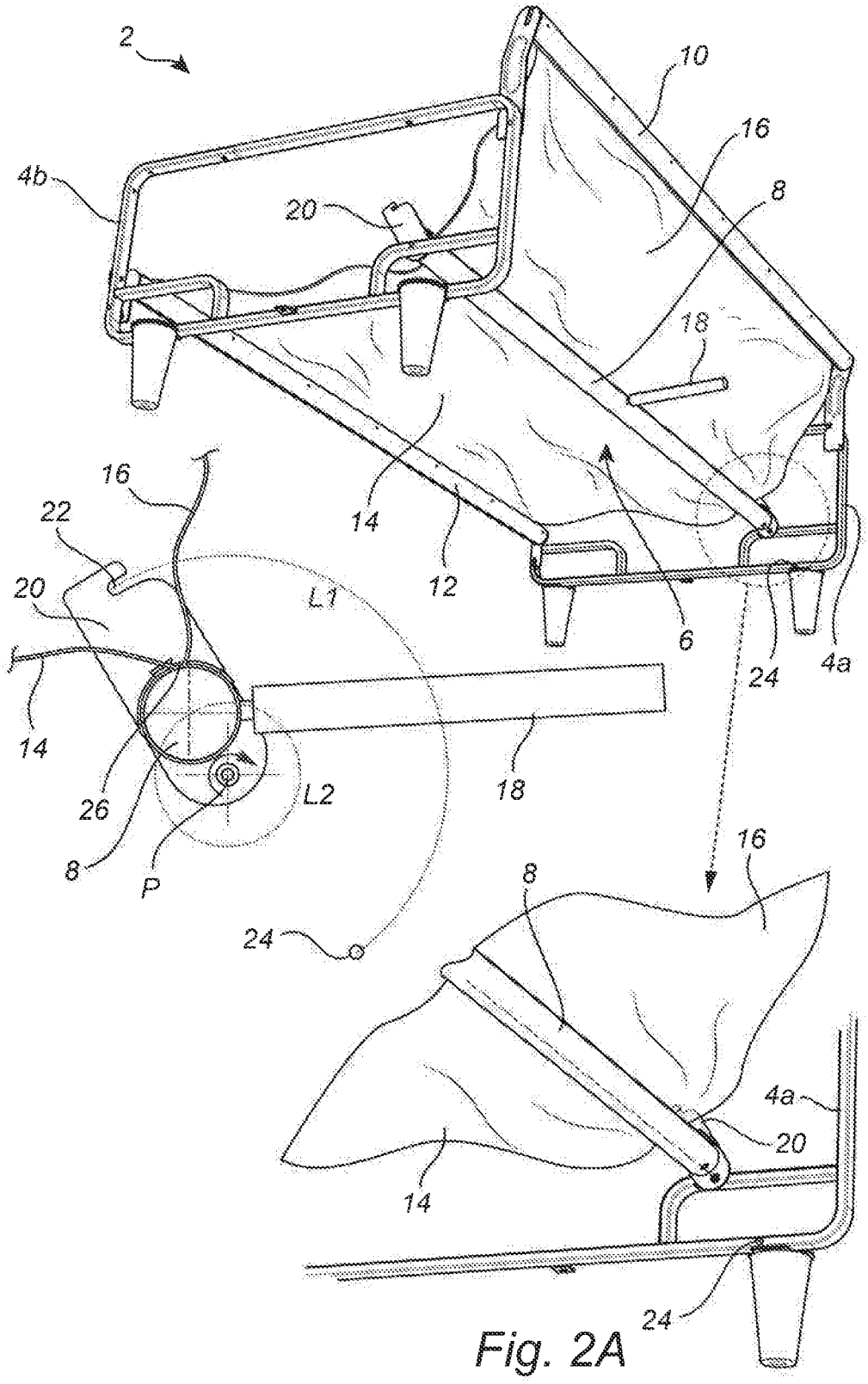
FIG. 2A shows a perspective view, close-up cross-sectional view, and close-up perspective view of a sofa with the support arrangement according to the present inventive concept in an initial position.

With reference to FIG. 2A, a sofa 2 comprises a frame comprising a first short-end section 4*a*, a second short-end section 4*b* and the support arrangement 6. The support arrangement 6 comprises a first longitudinal beam 8, a second longitudinal beam 12, and a third longitudinal beam 10 which carry the load of the seat and its occupant(s) to the short-end sections 4*a*, 4*b*.

The first longitudinal beam 8, the second longitudinal beam 12 and the third longitudinal beam 10 may be provided in a kit and mounted to the first short-end section 4*a* and the second short-end section 4*b* at the site of use of the sofa. As depicted in FIG. 2A they are each mounted between the first short-end section 4*a* and the second short-end section 4*b*. A first elastic sheet 14 is attached to the first longitudinal beam 8 and the second longitudinal beam 12 and a second elastic sheet 16 is attached to the first longitudinal beam 8 and the third longitudinal beam 10.

The second longitudinal beam 12 and the third longitudinal beam 10 are fixed with respect to the first short-end section 4*a* and the second short-end section 4*b*, while the first longitudinal beam 8 is pivotable, through plates 20, about a pivot axis running between a first pivot point P on the first short-end section 4*a* and a corresponding second pivot point on the second short-end section 4*b*. A lever 18, functioning as a handle, adapted to aid pivoting of the first longitudinal beam 8, is fixed to the first longitudinal beam 8 at a midpoint between the first short-end section 4*a* and the second short-end section 4*b* of the frame. Other locations for a lever or handle, as well at a different number of handles are equally possible, or no handle at all with an external force or torque provided through different means.

In embodiments where the stretching member is separate from the first longitudinal beam 8, as discussed in conjunction with FIG. 4 below, the handle 8 or lever will be located on the stretching member. Preferably, the handle is removable, for example by being screw-mountable on the first longitudinal beam 8. In that case, the lever 18 may be threaded as to be screw-mounted in a corresponding threaded bore in the first longitudinal beam 8 to be easily mountable before use and dismountable after use. Alternatively, the lever 18 may be foldable into or against the first longitudinal beam 8 after use.

Again with reference to FIG. 2A, a cross-sectional view of the area close to the first pivot point P shows the longitudinal beam 8, the lever 18, the first sheet 14 and the second sheet 16. The sheets 14, 16 attach to the first longitudinal beam 8 at an attachment point 26 which is rotatable with respect to the longitudinal beam 8. The attachment point 26 is offset with respect to the pivot axis running between the first pivot point P and the second pivot point.

In the present embodiment, an elastic sheet folds around the first longitudinal beam 8 forming a pocket, which is closed by a seam at the attachment point 26. The elastic sheet in the form of the pocket is rotatable with respect to the first longitudinal beam 8. In this configuration, the first elastic sheet 14 and the second elastic sheet 16 may be part of the same elastic sheet.

A vertical, or close to vertical, plate 20 is fixed with respect to the first longitudinal beam 8 close to the first short-end section 4*a* of the frame. The plate has a slot 22 configured to interact with a stop on the first short-end section of the frame in the form of a pin 24. An identical plate 20 configured to interact with an identical tap (not visible) in the second short-end section 4*b* located close to the second short-end section 4*b* of the frame. The plates 20, and thereby the first longitudinal beam 8, are pivotable around the first pivot point P and the second pivot point (not visible) respectively.

The first longitudinal beam 8, the lever 18, and the plates 20 provide a mechanism for, during assembly of the sofa, stretching the first elastic sheet 14 between the first longitudinal beam 8 and the second longitudinal beam 12, and further for stretching the second elastic sheet 16 between the first longitudinal beam 8 and the third longitudinal beam 10, where first longitudinal beam 8 functions as a stretching member for the elastic sheets, as will be described below.

Figure 2B:
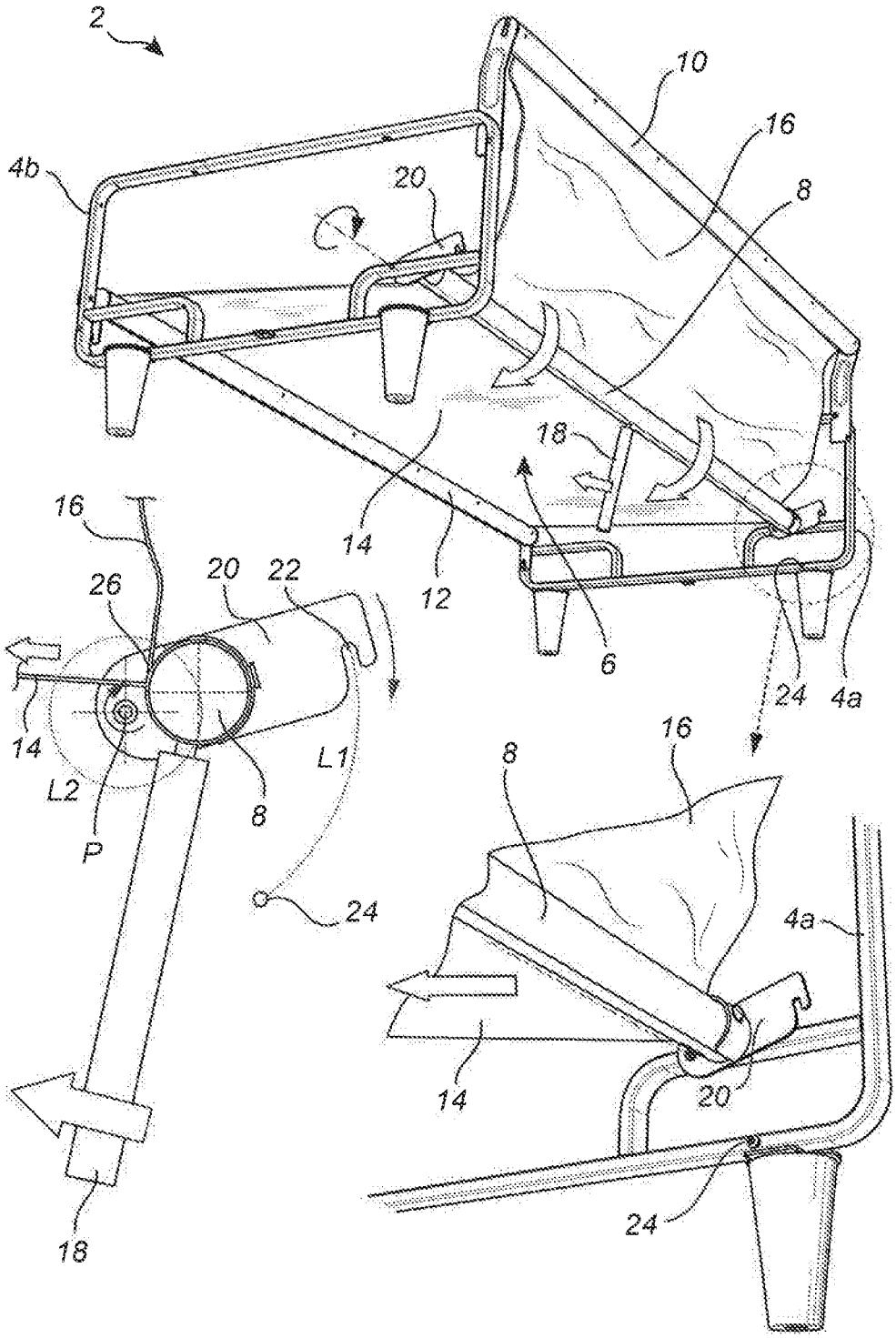
FIG. 2B shows a perspective view, close-up cross-sectional view, and close-up perspective view of a sofa with the stretching member of the support arrangement pivoting in an intermediate position.

In the cross-sectional view of FIG. 2A, a circular arc L1 shows the path traveled by the slot 22 of the plate 20 when the first longitudinal beam 8 pivots around the pivot point P. Similarly, a second circular arc L2 shows the path traveled by the center of the first longitudinal beam 8 during the same pivoting movement. Thus, since the attachment point 26 is offset with respect to the pivot axis running between the first pivot point P and the second pivot point, the first elastic sheet 14 is, with the sofa seating furniture support arrangement 6 in installed position, connected to the stretching member, which in this embodiment is identical to the first longitudinal beam 8, in such a way that the first longitudinal beam 8 pivoting with respect to the frame, in response to an application of an external force or torque, stretches the first elastic sheet 14. FIG. 2B shows the same arrangement as in FIG. 2A during pivoting of the first longitudinal beam 8, the pivoting motion being driven by the application of an external force on the lever 18, as shown with large straight arrows. During pivoting, shown with small curved arrows, the distance between the attachment point 26 and the second longitudinal beam 12 will increase, thereby starting to stretch the first elastic sheet 14. The tension force of the first elastic sheet 14, shown with a large straight arrow next to the first elastic sheet 14 in the cross-sectional view, will counteract the pivoting movement, as its leverage with respect to the pivot point P is opposite to that of the externally applied force. Thus, the external force applied to the lever 18 will need to work against the tension force of the first elastic sheet 14. Since the attachment point 26 is rotatable with respect to the first longitudinal beam 8, the tension force of the first elastic sheet 14 will cause the attachment point 26 to move around the first longitudinal beam 8 so that the stretched first elastic sheet 14 is perpendicular to the surface of the first longitudinal beam 8. The path followed by the attachment point 26, offset from the pivot point P, at this stage of pivoting will be determined by this condition.

In alternative embodiments (not shown) the attachment point 26 may instead be fixed with respect to the first longitudinal beam 8 and the plates 20, i.e., to the stretching member. In this case the attachment point 26, offset from the pivot point P, will during pivoting follow a circular path similar to L1 or L2.

In the shown embodiment, the first longitudinal beam 8 has a circular cross-section. However, other alternatives such a rectangular or elliptic cross-section are possible. The longitudinal beam 8 may either be fixed with respect to the plates 20, resulting in an attachment point 26 fixed with respect to the plates 20, or be pivoted at the plates 20 at a point offset from the first pivot points P and the second pivot point.

Figure 2C:
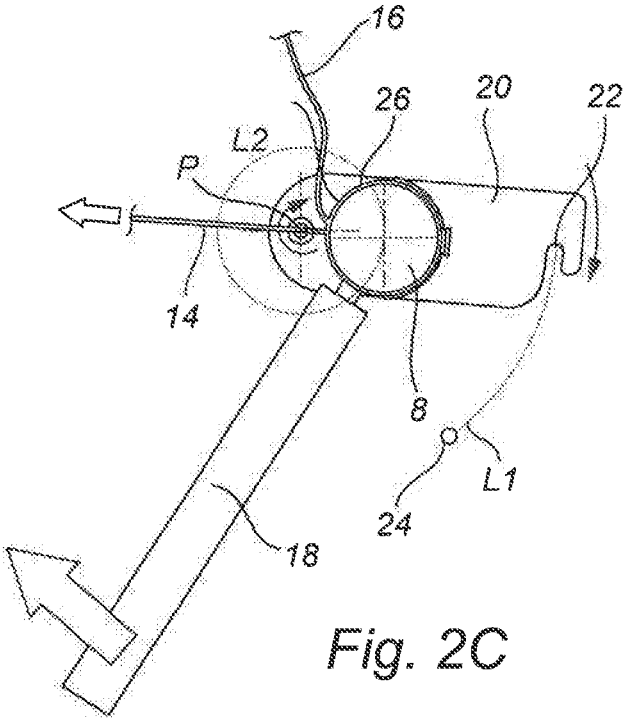
FIG. 2C is a close-up cross-sectional view with the stretching member of the support arrangement pivoting at a position corresponding to the point of maximum tension.

With the pivoting motion continuing, the external force applied to the lever 18 will continue to work against the tension force of the first elastic sheet 14, with the length of the lever arm of the tension force with respect to the pivot point P decreasing, and the tension force increasing, until a point, i.e., position, of maximum tension force is reached, as shown in a cross-sectional view in FIG. 2C. Here, with the first elastic sheet 14 crossing the pivot point P, the lever arm of the tension force of the first elastic sheet 14 has been reduced to zero, thus applying no torque with respect to the pivot point P.

With further pivoting movement driven by the externally applied force on the lever 18, the lever arm of the tension force of the first elastic sheet 14 will produce a torque around the pivot point P of opposite sign compared to the situation before the pivoting movement reached the position of maximum tension, thus resulting in a torque working in the same direction as the externally applied force on the lever 18. Thus, the tension force of the first elastic sheet 14 will from now on facilitate the pivoting until the slot 22 of the plate 20 has reached the stop in the form of the pin 21, as shown in FIG. 2D.

Figure 2D:
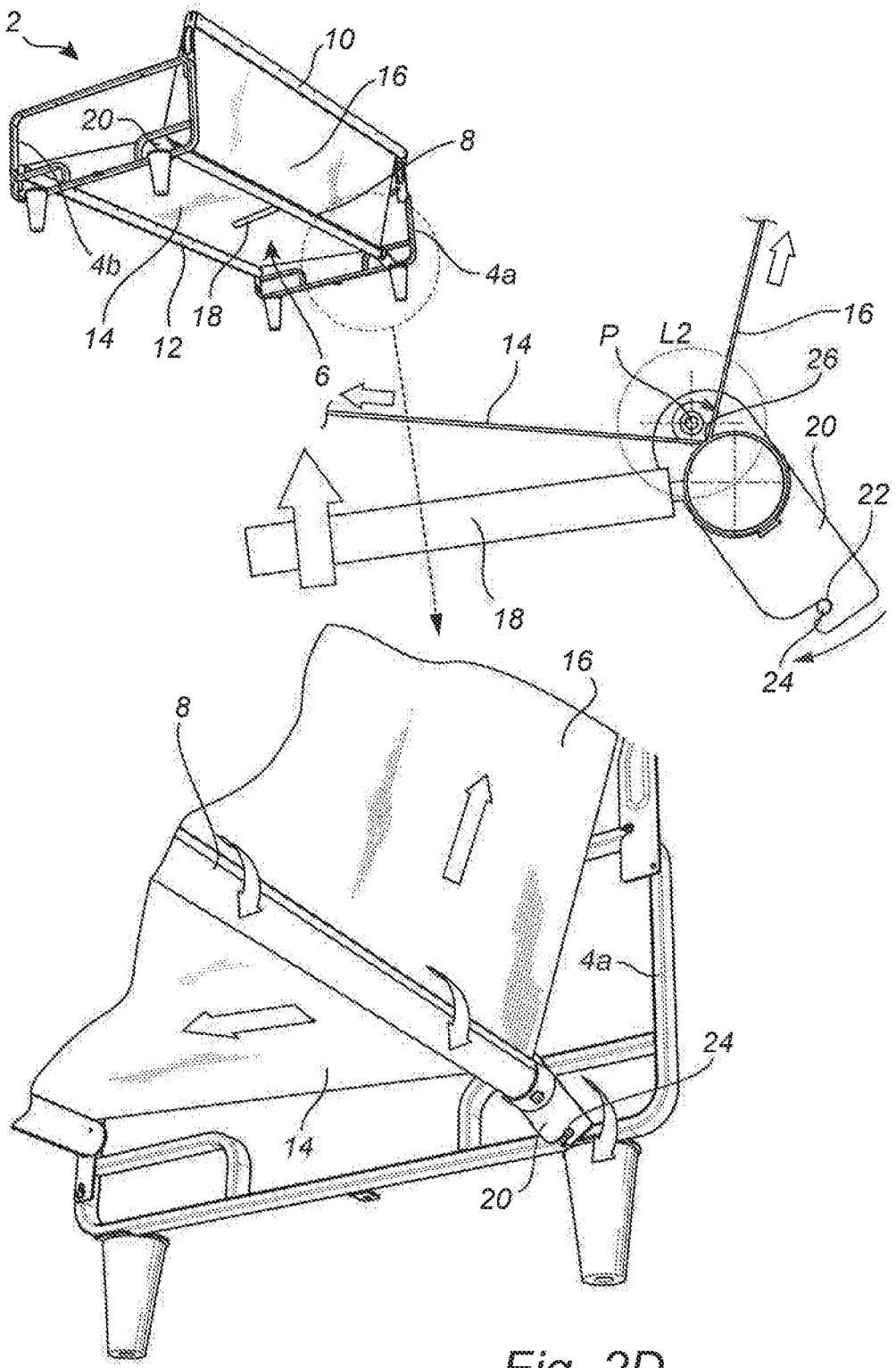
FIG. 2D is a perspective view, close-up cross-sectional view, and close-up perspective view of a sofa with the stretching member of the support arrangement in final position, with the elastic sheets stretched.

Thus, due to the attachment point 26 being offset from the pivot point P, the torque provided by the external force on the lever 18, works against the torque provided by the tension force of the first elastic sheet 14 until the position maximum tension is reached, as depicted in FIG. 2C, past which position of maximum tension the tension force of the first elastic sheet 14 instead facilitates further pivoting of the first longitudinal beam 8, acting to keep the stretching member in place its final position, as depicted in FIG. 2D.

Through the leverage made possible, the mechanism is easy to operate even when having a high tension in the elastic sheets, providing good rigidity to the support.

The elastic sheets 14, 16 need to be elastic enough to be able to be brought to the position of maximum tension. However, in general, a large degree of elasticity is not required in the elastic sheets, i.e., their coefficient of elasticity, defined as the ratio of tension force to degree of stretching, may be rather high. For a given geometry of the stretching member, a higher coefficient of elasticity allows for a high degree of tension of the sheet, giving rigid support for the seat och backrest.

Optionally, a latch (not shown) may be provided to prevent the first longitudinal beam 8 from sliding back from the final position, for example due to an externally applied force.

In the embodiment shown in FIGS. 2A-2D, the second elastic sheet 16 and the distance between the attachment point 26 and the third longitudinal beam 10 are arranged so that the second elastic sheet remains slack during the pivoting movement up to the position of maximum tension (FIG. 2C) of the first elastic sheet 14, only being stretched after that point. Thus, in this embodiment, during pivoting, the external force works against the tension force of the first elastic sheet up to the position of maximum tension, with the second elastic sheet only being stretched with the pivoting having passed the position of maximum tension. In this way, the tension force of one of the first elastic sheet 14 helps to stretch the second elastic sheet 16 past the position of maximum tension, with the effect of less external force being needed to pivot the stretching member up to that point. With both the first elastic sheet 14 and the second elastic sheet 16 being stretched, the position of the attachment point 26, being rotatable around the first longitudinal beam 8, will be determined by the condition that the vector sum of the tension force of the first elastic sheet 14 and the tension force of the second elastic sheet 16 is perpendicular to the surface of the first elastic beam 8.

In an alternative embodiment (not shown) both the first elastic sheet 14 and the second elastic sheet 16 are stretched simultaneously up to the position of maximum tension. In that case, the position of maximum tension will be defined based on the vector sum of the tension force of the first elastic sheet 14 and the tension force of the second elastic sheet 16. As a further alternative, there may be only one elastic sheet, either for providing support for the seat or for the backrest.

Figure 4:
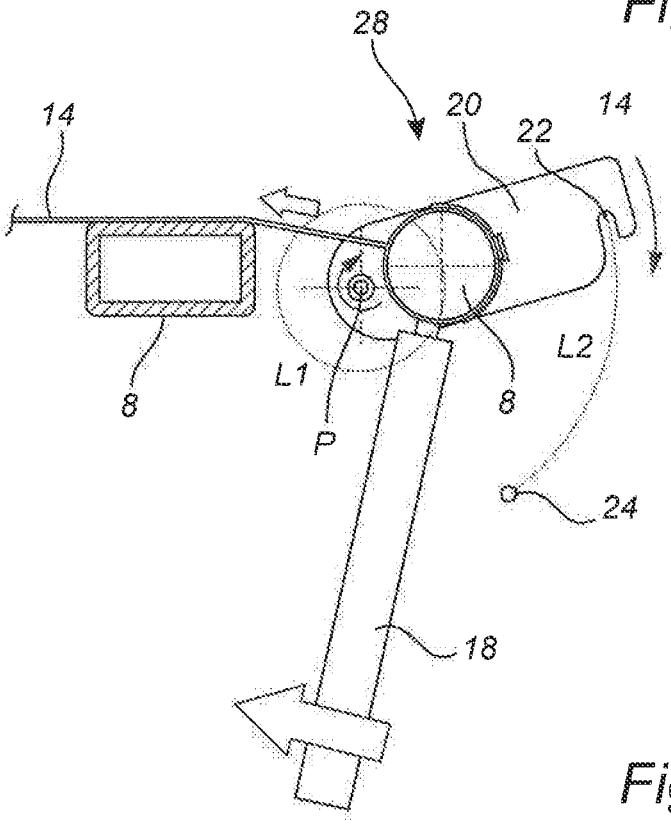
FIG. 4 is a cross-sectional view showing an alternative embodiment where the stretching member is separate from the first longitudinal beam.

FIG. 4 shows an alternative embodiment, in a cross-sectional view, where the first longitudinal beam 8 is separate from the mechanism 28 for stretching the first elastic sheet 14 and fixed to the frame. As in the embodiments described in conjunction with FIGS. 2A-2D above, the elastic sheet 14 runs between the second longitudinal beam (not shown) and the first longitudinal beam 8. However, instead from being fixed at the first longitudinal beam, it now continues to the separate stretching mechanism 28. In the depicted embodiment, the first elastic sheet 14 lies on top of the first longitudinal beam 8. However, other arrangements, such as the first elastic sheet 14 running through a slot or opening in the first longitudinal beam 8, are equally possible. The stretching mechanism 28 operates according to the same principle as described above in conjunction with FIGS. 2A-2D. In the depicted embodiment, the first elastic sheet 14 attached to a cylindrical structure similar to the first longitudinal beam depicted in FIGS. 2A-2D, however, this structure, to which the elastic sheet 14, is fixed, may in this embodiment be smaller, as it does not carry the load of, for example, an occupant of the sofa. In this embodiment, all other structures may be identical to what was described above in conjunction with FIGS. 2A-2D.

Figure 3:
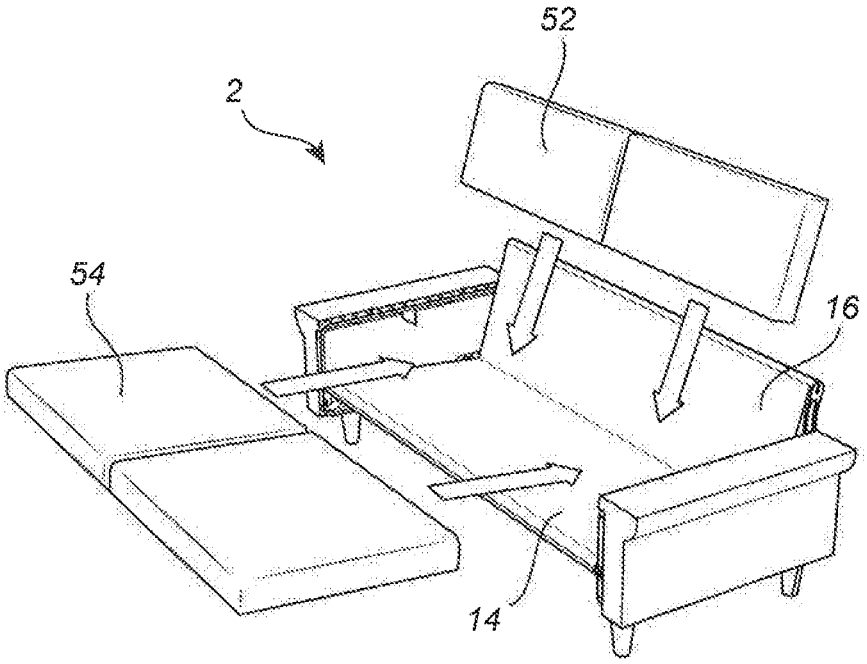
FIG. 3 shows a perspective view of a sofa with the support arrangement in final position, with the elastic sheets stretched, illustrating seat and backrest pillows being added to complete the sofa.

Finally, FIG. 3 shows the sofa 2 where the first elastic sheet 14 and the second elastic sheet 16 have been stretched according to the procedure described above. With the stretched first elastic sheet 14 now providing support for the seats of the sofa, pillows 54 may be added, as indicated with arrows, to complete the sofa seats. Likewise, with the second elastic sheet 16 now providing support for the backrest of the sofa, pillows 52 may be added to complete the backrest.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

The following summarizes examples:

There is provided a sofa seating furniture support arrangement for a seat or a backrest, comprising a first and a second longitudinal beam, each being mountable to a seating furniture frame comprising one or more parts; an elastic sheet for providing support for one of the seat and the backrest; and a mechanism for stretching the elastic sheet between the first longitudinal beam and the second longitudinal beam. The mechanism comprises a stretching member pivotable on the frame. The elastic sheet is, with the sofa seating furniture support arrangement in installed position, connected to the stretching member in such a way that the stretching member pivoting with respect to the frame, in response to an application of an external force or torque, stretches the elastic sheet, with the external force or torque working against the tension force of the elastic sheet until a point of maximum tension is reached, past which point of maximum tension the tension force facilitates further pivoting of the stretching member, acting to keep the stretching member in place in a final position.

This arrangement results in a tension mechanism that is easy to operate at the point of assembly, while still allowing for a high degree of tension in the elastic sheet, resulting in good rigidity of the support. This is turn allows for the use of the arrangement in in larger pieces of furniture than was previously possible.

In general, a large degree of elasticity is not required in the elastic sheets, i.e., their coefficient of elasticity, defined as the ratio of tension force to degree of stretching, may be rather high.

The stretching member may be the first longitudinal beam itself. This allows for a simple construction yet strong construction that still is easy to operate.

The elastic sheet may be a first elastic sheet and the seating furniture support arrangement may further comprise a third longitudinal beam and a second elastic sheet for providing support for the other of the seat and the backrest, where the second elastic sheet is also connected to the stretching member of the mechanism, so that the pivoting of the stretching member also stretches the second elastic sheet between the first beam and the third beam.

The seating furniture support arrangement may be arranged so that the external force or torque works against the tension force of one of the first elastic sheet and the second elastic sheet up to the point of maximum tension, the other of the first elastic sheet and the second elastic sheet only being stretched with the pivoting having passed the point of maximum tension. In this way, the tension force of one of the sheets may be used to stretch the other sheet past the point of maximum tension, with less force or torque being needed to pivot the stretching member up to that point, than if both elastic sheets had been stretched at the same time.

Alternatively, the seating furniture support arrangement may be arranged so that the external force or torque works against the tension forces of both the first elastic sheet and the second elastic sheet up to the point of maximum tension. This allows for a high final degree of tension in both sheets.

The elastic sheet may, with the seating furniture support arrangement in installed position, fold around the stretching member forming a pocket, preferably being closed by a seam. This arrangement is easy to manufacture while still being durable.

The seating furniture support arrangement may further comprise a lever for applying the external force or torque for pivoting the stretching member, where the lever preferably is removable or foldable after use. This makes it easy to operate the mechanism.

The seating furniture support arrangement may further comprise a stop, against which the tension force of the elastic sheet acts through the stretching member to lock the stretching member in place in the final position.

The seating furniture support may further comprise a latch further acting to lock the stretching member in place in the final position.

Further, there is provided a piece of seating furniture comprising the seating furniture support arrangement above, and a kit for assembling a piece of seating furniture comprising the support arrangement above.

According to a further aspect, there is provided a method of assembling a piece of seating furniture, comprising providing a seating furniture frame in one or more parts, a first longitudinal beam and a second longitudinal beam, each attached to the seating furniture frame, and an elastic sheet for providing support for a seat or a backrest; and stretching the elastic sheet between the first longitudinal beam and the second longitudinal beam, where the stretching of the elastic sheet comprises applying an external force or torque to pivot a stretching member with respect to the frame, wherein the elastic sheet is connected to the stretching member in such a way that the pivoting stretches the elastic sheet, the external force or torque working against the tension force of the elastic sheet until a point of maximum tension is reached, past which point of maximum tension the tension force facilitates further pivoting of the stretching member, acting to lock the stretching member in place in a final position.

The following lists examples summarized above:

1. A seating furniture support arrangement (6) for a seat or a backrest, comprising:

a first (8) and a second (12) longitudinal beam, each being mountable to a seating furniture frame comprising one or more parts;

an elastic sheet (16; 14) for providing support for one of said seat and said backrest; and a mechanism for stretching said elastic sheet between said first longitudinal beam (8) and said second longitudinal beam (10; 12), characterized by said mechanism comprising:

a stretching member (8; 28) pivotable on said frame, said elastic sheet (16; 14), with said seating furniture support arrangement (6) in installed position, being connected to said stretching member (8; 28) in such a way that said stretching member (8; 28) pivoting with respect to said frame, in response to an application of an external force or torque, stretches said elastic sheet (16; 14), said external force or torque working against the tension force of said elastic sheet (16; 14) until a point of maximum tension is reached, past which point of maximum tension said tension force facilitates further pivoting of said stretching member (8; 28), acting to keep said stretching member (8; 28) in place in a final position.

2. The seating furniture support arrangement (6) of the preceding example, wherein said stretching member is said first longitudinal beam (8).

3. The seating furniture support arrangement (6) of any one of the preceding examples, wherein said elastic sheet (16; 14) is a first elastic sheet (14) and said seating furniture support arrangement further comprises:

a third longitudinal beam (10); and a second elastic sheet (16) for providing support for the other of said seat and said backrest, said second elastic sheet (16) also being connected to said stretching member of said mechanism, so that said pivoting of said stretching member also stretches said second elastic sheet (16) between said first beam (8) and said third longitudinal beam (10).

4. The seating furniture support arrangement (6) of example 3, wherein said external force or torque works against the tension force of one of said first elastic sheet (16; 14) and said second elastic sheet (14; 16) up to said point of maximum tension, the other of said first elastic sheet and said second elastic sheet only being stretched with said pivoting having passed said point of maximum tension.

5. The seating furniture support arrangement (6) of example 3, wherein said external force or torque works against the tension forces of both said first elastic sheet (16; 14) and said second elastic sheet (14; 16) up to said point of maximum tension.

6. The seating furniture support arrangement (6) of any one of the preceding examples, wherein said elastic sheet (16; 14), with said seating furniture support arrangement (6) in installed position, folds around said stretching member forming a pocket, said pocket preferably being closed by a seam (26).

7. The seating furniture support arrangement of any one of the preceding examples, further comprising a lever (18) for applying said external force or torque for pivoting said stretching member (8; 28), said lever preferably being removable or foldable after use.

8. The seating furniture support arrangement (6) of any one of the preceding examples, further comprising a stop (24), against which stop (24) said tension force of said elastic sheet (16;14) acts through said stretching member (8; 28) to lock said stretching member (8; 28) in place in said final position.

9. The seating furniture support arrangement (6) of any one of the preceding examples, further comprising a latch further acting to lock said stretching member (8; 28) in place in said final position.

10. A piece of seating furniture (2) comprising the seating furniture support arrangement (6) of any one of the preceding examples.

11. A kit for assembling a piece of seating furniture comprising the support arrangement (6) of any one of examples 1-9.

The invention claimed is:

1. A seating furniture support arrangement for a seat or a backrest, comprising:

a first load-carrying longitudinal beam and a second load-carrying longitudinal beam, each being mountable to a seating furniture frame comprising one or more short-end section(s);

an elastic sheet for providing support for one of said seat and said backrest; and a mechanism for stretching said elastic sheet between said first longitudinal beam and said second longitudinal beam, said mechanism comprising:

said first longitudinal beam being pivotable on said frame around a pivot axis, said elastic sheet, with said seating furniture support arrangement in installed position, being connected to said first longitudinal beam offset to said pivot axis so that said first longitudinal beam pivoting with respect to said frame, in response to an application of an external force or torque, stretches said elastic sheet, said external force or torque working against a tension force of said elastic sheet until a point of maximum tension is reached, past which point of maximum tension said tension force facilitates further pivoting of said first longitudinal beam, acting to keep said first longitudinal beam in place in a final position.

2. The seating furniture support arrangement of claim 1, wherein said elastic sheet is a first elastic sheet and said seating furniture support arrangement further comprises:

a third longitudinal beam; and a second elastic sheet for providing support for the other of said seat and said backrest, said second elastic sheet also being connected to said first longitudinal beam of said mechanism, so that said pivoting of said first longitudinal beam also stretches said second elastic sheet between said first beam and said third longitudinal beam.

3. The seating furniture support arrangement of claim 2, wherein said external force or torque works against the tension force said first elastic sheet up to said point of maximum tension or against a tension force of said second elastic sheet up to a point of maximum tension, the other of said first elastic sheet and said second elastic sheet only being stretched with said pivoting having passed said point of maximum tension.

4. The seating furniture support arrangement of claim 2, wherein said external force or torque works against the tension force of said first elastic sheet up to said point of maximum tension and against a tension force of said second elastic sheet up to a point of maximum tension.

5. The seating furniture support arrangement of claim 1, wherein said elastic sheet, with said seating furniture support arrangement in installed position, folds around said first longitudinal beam forming a pocket, said pocket preferably being closed by a seam.

6. The seating furniture support arrangement of claim 1, further comprising a lever for applying said external force or torque for pivoting said first longitudinal beam, said lever preferably being removable or foldable after use.

7. The seating furniture support arrangement of claim 1, further comprising a stop, against which stop said tension force of said elastic sheet acts through said first longitudinal beam to lock said first longitudinal beam in place in said final position.

8. The seating furniture support arrangement of claim 1, further comprising a latch further acting to lock said first longitudinal beam in place in said final position.

9. A piece of seating furniture comprising said seating furniture support arrangement of claim 1.

10. A kit for assembling a piece of seating furniture, said kit comprising the support arrangement claim 1.

11. A method of assembling a piece of seating furniture, comprising:

providing:

a seating furniture frame in one or more short-end sections(s);

a first load-carrying longitudinal beam and a second load-carrying longitudinal beam, each attached to said seating furniture frame; and an elastic sheet for providing support for a seat or a backrest; and stretching said elastic sheet between said first longitudinal beam and said second longitudinal beam, wherein said stretching of said elastic sheet comprises:

applying an external force or torque to pivot said first longitudinal beam with respect to said frame around a pivot axis, wherein said elastic sheet is connected to said first longitudinal beam offset to said pivot axis so that said pivoting stretches said elastic sheet, said external force or torque working against a tension force of said elastic sheet until a point of maximum tension is reached, past which point of maximum tension said tension force facilitates further pivoting of said first longitudinal beam, acting to lock said first longitudinal beam in place in a final position.

* * * * *